United States Patent [19]

Coombs et al.

[11] 4,306,922

[45] Dec. 22, 1981

[54] ELECTRO MAGNETIC STEELS

[75] Inventors: Alan Coombs, Newport; James H. R. Page, Machen, both of Wales

[73] Assignee: British Steel Corporation, London, England

[21] Appl. No.: 180,155

[22] Filed: Aug. 21, 1980

[30] Foreign Application Priority Data

Sep. 7, 1979 [GB] United Kingdom ..... 31139/79

[51] Int. Cl.[3] ..... H01F 1/04

[52] U.S. Cl. ..... 148/111; 148/120; 148/12 A

[58] Field of Search ..... 148/111-113, 148/120-122, 12 A

[56] References Cited

U.S. PATENT DOCUMENTS

| | | | |
|---|---|---|---|
| 2,104,169 | 1/1938 | Scharscha | 148/111 |
| 2,867,558 | 1/1959 | May | 148/111 |
| 2,939,810 | 7/1960 | Fiedler | 148/111 |
| 3,096,222 | 7/1963 | Fiedler | 148/111 |
| 3,214,303 | 10/1965 | Fiedler | 148/111 |
| 3,351,501 | 11/1967 | Aspden | 148/111 |
| 3,764,407 | 10/1973 | Hirano et al. | 148/112 |

*Primary Examiner*—L. Dewayne Rutledge
*Assistant Examiner*—John P. Sheehan
*Attorney, Agent, or Firm*—Bacon & Thomas

[57] ABSTRACT

A method for producing non-oriented steel for electromagnetic applications comprises hot rolling a steel containing a nitride/carbide former and coiling the hot band at a temperature of not less than 680° C. before cold reduction and annealing in a non-decarburizing atmosphere.

15 Claims, No Drawings

ELECTRO MAGNETIC STEELS

This invention relates to steels for electromagnetic applications and is particularly directed to non-oriented steels displaying magnetic ageing resistance.

Non-oriented silicon steels for electromagnetic applications are well known in the art and are produced generally in the form of sheet or strip in the fully annealed condition which is subsequently sheared or stamped into laminations. These laminations are stacked to form the cores of static or rotating electrical machines such as transformers and alternators and are magnetically excited by current flow through conductors wound around the cores.

In conventional non-oriented silicon steel particular attention must be paid to the processing of the material to avoid deterioration in the magnetic properties after processing has been completed. This deterioration of magnetic properties with time is termed magnetic ageing and is usually expressed as a percentage increase in total power loss (Watts/kg) at a specified induction. (e.g. 1.5 Tesla).

It is now accepted practice to reduce magnetic ageing by a decarburising anneal; decarburising is thus a vitally important but unfortunately expensive stage in the production of a non-oriented silicon steel. The process requires an atmosphere of either pure hydrogen or one rich in hydrogen which has to be saturated with water to achieve a specific dew point. This atmosphere can be expensive and difficult to handle. Temperature/times of annealing have to be closely controlled for optimum decarburisation rates.

It is an object of the present invention to provide a process route which will produce a magnetic ageing resistant, non-oriented silicon steel and which avoids a decarburising treatment in the finishing plant.

According to one aspect of the present invention, a method for producing non-oriented steel sheet for electromagnetic applications comprises hot rolling steel having less than 0.025% carbon, between 0.05% and 3.5% silicon, between 0.2% and 0.8% manganese, between 0.10% and 0.35% aluminium, between 0.003% and 0.008% nitrogen, together with a nitride/carbide former selected from the group consisting of titanium, niobium, tantalum, vanadium and zirconium, the remainder being iron except for incidental impurities, coiling the hot band at a temperature of not less than 680° C. and subjecting the subsequently cold reduced material of substantially final gauge to a non-decarburising anneal at a temperature lying within the range 900° C. to 1000° C.

Ideally, the non-decarburising final anneal should be carried out at a temperature in excess of 940° C. and preferably within the temperature range 950° C. to 1000° C.

The steel of this invention may be produced by any conventional steelmaking process. For example basic oxygen steelmaking, open hearth refining or electric arc steelmaking may be employed, with the required composition being achieved by techniques well known in the art. In the case of steel produced by basic oxygen steelmaking or open hearth refining, the carbon concentration is conveniently reduced by vacuum degassing. Alloying of the melt to produce the required composition may occur during, or after the vacuum degassing operation.

Preferably the hot band, which ideally is hot rolled at a finishing temperature of not less than 900° C. is coiled at a temperature in excess of 700° C. to produce optimum results.

The concentration of nitride/carbide former in the material of the invention suitably is selected to lie within the range by weight of 0.05% to 0.2% for titanium, 0.06% to 0.3% for vanadium, 0.05% to 0.3% for niobium, 0.12% to 0.3% for zirconium, and 0.10% to 0.3% for tantalum.

When phosphorus and sulphur generally are present at incidental impurity levels and can be tolerated at these levels, the concentration by weight of phosphorus should not exceed 0.04% while the concentration by weight of sulphur should not exceed 0.025%. In practice however where the steel of the invention before inoculation is produced by basic oxygen steelmaking, a lower concentration limit of 0.01% of phosphorus and 0.02% or possibly 0.015% of sulphur is likely to be achieved.

The hot band produced according to the present invention may be cold reduced to substantially final gauge in a single cold rolling operation or may be reduced to substantially final gauge in two stages with an intermediate anneal. In the case where two stage cold reduction is employed, the intermediate anneal conveniently is at a temperature lying within the range 850° C. to 1000° C. although a temperature lying within the range 900° C. to 1000° C. is preferred. While the intermediate anneal may be in a decarburising atmosphere, a non-decarburising anneal may equally be used and will of course display a number of advantages including cost benefit.

The use of a non-decarburising atmosphere in the final anneal of the cold reduced material of substantially final gauge produces no reduction of carbon concentration. However in conventional silicon steels a decarburising atmosphere is necessary to produce the low level of carbon required to minimise magnetic ageing resistance. If conventional silicon steels were processed in a non-decarburising atmosphere unsatisfactory levels of carbon would result which would be detrimental to the magnetic ageing characteristics.

The use of the process route according to the present invention displays the cost benefit of avoiding a decarburising anneal atmosphere previously necessary to achieve the low levels of carbon concentration essential to produce acceptable ageing and magnetic characteristics.

Embodiments of the invention will now be described with reference to the following examples.

EXAMPLES

EXAMPLE 1

A steel having the following composition by weight:

1.24% Si
0.34% Mn
0.015% C
0.025% S
0.014% P
0.095% Ti
0.15% Al
0.0059% N balance iron and incidental impurities, was made, cast into ingots, hot rolled into slabs and subsequently hot rolled to strip of nominal thickness 2.0 mm. The hot strip rolling was conventionally performed using a finishing temperature of 935° C. (1720° F.) and a coiling temperature of 680° C. (1250° F.).

The hot rolled material was pickled and cold reduced in a single rolling operation to a final thickness of 0.50 mm. The cold rolled material was then subjected to a final anneal in a non-decarburising atmosphere at 900° C. for approximately 2.5 minutes.

A typical power loss of 6.15 W/kg was obtained at 1.5T, 50 Hz on a longitudinal Epstein sample from material processed in this way.

Ageing tests, which consist of treating the samples at a temperature of 150° C. for 14 days followed by re-testing were carried out and substantially no deterioration in total power loss was found.

EXAMPLE 2

A steel was processed as in Example 1 to a final gauge of 0.50 mm. Non-decarburising annealing was carried out at a temperature of 950° C. for approximately 2.5 minutes.

A typical total power loss of 5.53 W/kg was attained at 1.5T, 50 Hz on a longitudinal Epstein sample.

The sample again showed substantially no magnetic ageing, within the testing limits detailed in Example 1.

EXAMPLE 3

A steel was processed as in Example 1 to a final gauge of 0.50 mm. Non-decarburising annealing was carried out at 1000° C. for approximately 2.5 minutes.

A typical power loss of 5.06 W/kg was achieved at 1.5T, 50 Hz on a longitudinal Epstein sample; similar ageing characteristics as in Examples 1 and 2 were obtained.

EXAMPLE 4

A steel having the following composition:

1.64% Si
0.014% C
0.31% Mn
0.019% S
0.25% Al
0.0060% N
0.083% Ti the balance being iron except for incidental impurities, was made and hot rolled in the manner of the previous examples to a strip thickness of 2.0 mm. After pickling the material was cold reduced to a final thickness of 0.65 mm in a single cold rolling operation. Final annealing was carried out in a non-decarburising atmosphere at 1000° C. for 2.5 minutes.

A typical total power loss of 5.40 W/kg at 1.5T, 50 Hz was obtained on a longitudinal sample. The sample again showed substantially no magnetic ageing, within the testing limits detailed in Example 1.

EXAMPLE 5

A steel having the following composition:

1.60% Si
0.014% C
0.32% Mn
0.019% S
0.25% Al
0.078% Ti
0.0054% N the balance being iron except for incidental impurities, was made and hot rolled in the conventional manner to a strip thickness of 2.0 mm. After pickling the material was cold reduced in a single rolling operation to a final thickness of 0.50 mm and given a final anneal at 940° C. in a non-decarburising atmosphere for 2.5 minutes.

A typical total power loss of 5.59 W/kg at 1.5T, 50 Hz was obtained on a longitudinal sample. The sample again showed substantially no magnetic ageing, within the testing limits detailed in Example 1.

EXAMPLE 6

A steel having following composition:

1.24% Si
0.34% Mn
0.011% C
0.025% S
0.017% P
0.10% Nb
0.13% Al
0.0059% N with the balance being iron except for incidental impurities, was made and hot rolled in a similar manner to that described in Example 1. In this case however the finishing temperature during hot rolling was 910° C. (1670° F.) and the coiling temperature 680° C. (1250° F.).

The hot rolled material was pickled and subsequently cold reduced in a single cold rolling operation to a thickness of 0.50 mm and given a final annealing treatment in a non-decarburising atmosphere at 1000° C. for 2.5 minutes.

A typical power loss of 7.15 W/kg at 1.5T, 50 Hz was obtained on a longitudinal Epstein sample. The material was substantially resistant to magnetic ageing, with the testing limits applied in previous examples.

EXAMPLE 7

A steel having the following composition:

1.32% Si
0.34% Mn
0.012% C
0.025% S
0.013% P
0.13% Ta
0.11% Al
0.0063% N balance being iron except for incidental impurities, was made and hot rolled in a similar manner to that described in Example 1. In this case however finishing temperature during hot rolling was 910° C. (1770° F.) and the coiling temperature 680° C. (1250° F.).

The hot rolled strip was pickled and cold reduced to a final thickness of 0.50 mm in a single cold rolling operation. The cold rolled material was given a final anneal in a non-decarburising atmosphere at a temperature of 1000° C. for 2.5 minutes.

A typical power loss of 6.48 W/kg at 1.5T, 50 Hz was attained on a longitudinal Epstein sample. The material was substantially resistant to magnetic ageing, within the test limits imposed in previous examples.

EXAMPLE 8

A steel having the composition described with reference to Example 1 was made and hot rolled in the usual way. Hot rolled strip, nominally 2.0 mm in thickness, was produced using a finishing temperature of 900° C. (1660° F.) and a coiling temperature of 680° C. (1250° F.).

After pickling the hot rolled material was cold reduced to an intermediate thickness of 0.55 mm and given an inter anneal at 900° C. in a non-decarburising atmosphere.

The material was then cold reduced to a final thickness of 0.50 mm followed by final annealing in a non-decarburising atmosphere at 900° C. for approximately 2.5 minutes.

A typical power loss for material processed in this manner is 4.97 W/kg at 1.5T, 50 Hz on a longitudinal sample. Magnetic ageing tests confirmed good ageing resistance.

EXAMPLE 9

A steel having the composition as detailed in Example 6 was made and hot rolled in the manner described.

The hot rolled material was pickled, cold reduced to an intermediate thickness of 0.55 mm and given an inter anneal of 900° C. in a non-decarburising atmosphere. The annealed material was then cold reduced to a final thickness of 0.50 mm and subsequently finally annealed at 950° C. for about 2.5 minutes in a non-decarburising atmosphere.

A typical power loss for material processed in this way is 4.80 W/kg at 1.5T, 50 Hz on a longitudinal Epstein sample. Substantially no magnetic ageing was exhibited by the samples when tested in the manner previously described.

EXAMPLE 10

A steel having the composition as detailed in Example 7 was made and hot rolled in the manner described.

The hot rolled material was pickled, cold reduced to an intermediate thickness of 0.55 mm and given an intermediate anneal at 850° C. in a non-decarburising atmosphere. The annealed material was then cold reduced to a final thickness of 0.50 mm and subsequently finally annealed at 900° C. for about 2.5 minutes in a non-decarburising atmosphere.

A typical power loss for material processed in this way is 5.08 W/kg at 1.5T, 50 Hz on a longitudinal Epstein sample. Substantially no magnetic ageing was exhibited by the sample, when tested as previously described.

EXAMPLE 11

A steel having the following composition by weight:
0.89% Si
0.28% Mn
0.015% C
0.018% S
0.012% P
0.068% Ti
0.10% Al
0.0059% N
balance iron and incidental impurities, was made, cast into ingots, hot rolled into slabs and subsequently hot rolled to strip of nominal thickness 2.0 mm. The hot strip rolling was conventionally performed using a finishing temperature of 935° C. (1720° F.) and a coiling temperature of 680° C. (1250° F.).

The hot rolled material was pickled and cold reduced in a single rolling operation to a final thickness of 0.50 mm. The cold rolled material was then subjected to a final anneal in a non-decarburising atmosphere at 940° C. for approximately 1 minute.

A typical power loss of 5.56 W/kg was obtained at 1.5T, 50 Hz on a longitudinal Epstein sample from material processed in this way.

The sample again showed substantially no magnetic ageing, within the testing limits detailed in Example 1.

EXAMPLE 12

A steel having the following composition by weight:
2.34% Si
0.31% Mn
0.011% C
0.025% S
0.011% P
0.079% Ti
0.27% Al
0.0059% N
balance iron and incidental impurities, was processed as in Example 11.

A typical power loss 4.60 W/kg was obtained at 1.5T, 50 Hz on a longitudinal Epstein sample from material processed in this way.

The sample again showed substantially no magnetic ageing, within the testing limits detailed in Example 1.

EXAMPLE 13

A steel having the following composition by weight:
1.67% Si
0.33% Mn
0.010% C
0.016% S
0.013% P
0.085% V
0.23% Al
0.0059% N
balance iron and incidental impurities, was processed as in Example 11.

A typical power loss of 4.56 W/kg was obtained at 1.5T, 50 Hz on a longitudinal Epstein sample from material processed in this way.

The sample again shows substantially no magnetic ageing, within the testing limits detailed in Example 1.

Whilst in no way meant to be limiting, the normal method of production of the steels of the examples is by the basic oxygen process followed by vacuum degassing.

In the examples, where two stage cold reduction is employed, the thickness of the strip after the first cold rolling operation preferably lies within the range 0.55–0.75 mm.

We claim:

1. A method for producing non-oriented steel sheet for electromagnetic applications which comprises hot rolling steel having less than 0.025% carbon, between 0.05% and 3.5% silicon, between 0.2% and 0.8% manganese, between 0.10% and 0.35% aluminium, between 0.003% and 0.008% nitrogen, together with a nitride/carbide former selected from the group consisting of titanium, niobium, tantalum, vanadium, and zirconium, the remainder being iron except for incidental impurities, coiling the hot band at a temperature of not less than 680° C. subsequently cold reducing the band and then subjecting the cold reduced material of substantially final gauge to a non-decarburising anneal at a temperature lying within the range 900° C. to 1000° C. whereby a structure having a large primary grain size essentially randomly oriented is developed.

2. A method as claimed in claim 1 in which the non-decarburising final anneal is at a temperature within the range 940° C. to 1000° C.

3. A method as claimed in claim 2 wherein the non-decarburising final anneal is at a temperature within the range 950° C. to 1000° C.

4. A method as claimed in claim 3 in which the steel is produced by any conventional steel making process.

5. A method as claimed in claim 4 wherein the steel is produced by basic oxygen or open hearth refining and is subject to vacuum degassing to reduce the carbon concentration to the selected level.

6. A method as claimed in claims 1, 2, 3, 4 or 5 in which the hot band is hot rolled at a finishing temperature greater than 900° C.

7. A method as claimed in claim 1 in which the hot band is coiled at a temperature greater than 700° C.

8. A method as claimed in claim 7 wherein the hot band is cold reduced to substantially final gauge in a single cold rolling operation.

9. A method as claimed in claim 7 wherein the hot band is cold reduced to substantially final gauge in two stages of cold rolling with an intermediate anneal.

10. A method as claimed in claim 9 wherein the intermediate anneal is at a temperature within the range 850° C. to 1000° C.

11. A method as claimed in claim 10 wherein the intermediate anneal is at a temperature within the range 900° C. to 1000° C.

12. A method as claimed in claim 9 in which the intermediate anneal is in a non-decarburising atmosphere.

13. A method as claimed in claim 1 wherein the concentration of nitride/carbide former is selected to lie within the range 0.05%–0.2% by weight for titanium, 0.06%–0.3% for vanadium, 0.05%–0.3% for niobium, 0.12%–0.3% for zirconium and 0.10%–0.3% for tantalum.

14. A method as claimed in claim 13 wherein the concentration by weight of phosphorus and sulphur is not greater than 0.04% and 0.025% respectively.

15. A method as claimed in claim 5 in which the nitride/carbide former is added during or after vacuum degassing.

* * * * *